United States Patent [19]

Schumacher et al.

[11] Patent Number: 5,073,278

[45] Date of Patent: Dec. 17, 1991

[54] LUBRICANT COMPOSITION

[75] Inventors: Rolf Schumacher; Samuel Evans; Paul Dubs, all of Marly, Switzerland

[73] Assignee: Ciba-Geigy Corporation, Ardsley, N.Y.

[21] Appl. No.: 380,563

[22] Filed: Jul. 13, 1989

[30] Foreign Application Priority Data

Jul. 18, 1988 [CH] Switzerland ..... 2737/88

[51] Int. Cl.[5] ..... C10M 133/40

[52] U.S. Cl. ..... 252/47.5; 252/47.0; 252/50; 252/51.5 R

[58] Field of Search ..... 252/50, 51.5 R, 47, 252/47.5; 546/188, 184

[56] References Cited

U.S. PATENT DOCUMENTS

| | | | |
|---|---|---|---|
| 3,218,256 | 11/1965 | Edwards | 252/47 |
| 3,480,635 | 11/1969 | Altwicker | 260/293 |
| 3,523,910 | 8/1970 | Randell | 252/47 |
| 3,535,243 | 10/1970 | Chao et al. | 252/50 |
| 3,539,515 | 11/1970 | McCabe | 252/47 |
| 3,689,484 | 9/1972 | Spilners | 252/47 |
| 3,773,665 | 11/1973 | Braid | 252/50 |
| 3,822,209 | 7/1974 | Knapp et al. | 546/184 |
| 3,844,958 | 10/1974 | Anderson et al. | 252/50 |
| 4,370,246 | 1/1983 | deVries et al. | 252/50 |
| 4,461,898 | 7/1984 | Meier et al. | 546/188 |
| 4,525,503 | 6/1985 | Cantatore | 546/188 |
| 4,540,732 | 9/1985 | Spivack et al. | 524/289 |
| 4,601,839 | 7/1986 | Lai | 252/51.5 A |
| 4,691,015 | 9/1987 | Behrens et al. | 546/188 |
| 4,692,258 | 9/1987 | Rasberger et al. | 252/50 |
| 4,695,599 | 9/1987 | Cantatore | 546/188 |
| 4,824,601 | 4/1989 | Franklin | 252/50 |

FOREIGN PATENT DOCUMENTS

| | | |
|---|---|---|
| 049133 | 4/1982 | European Pat. Off. . |
| 0059168 | 9/1982 | European Pat. Off. . |
| 0239536 | 9/1987 | European Pat. Off. . |
| 0286595 | 10/1988 | European Pat. Off. . |
| WO88/02007 | 3/1988 | PCT Int'l Appl. . |
| 0933505 | 8/1963 | United Kingdom . |
| 1090688 | 12/1967 | United Kingdom . |
| 1140089 | 1/1969 | United Kingdom . |
| 1347141 | 2/1974 | United Kingdom . |
| 1438482 | 6/1976 | United Kingdom . |

*Primary Examiner*—Prince Willis, Jr.
*Assistant Examiner*—Ellen McAvoy
*Attorney, Agent, or Firm*—Harry Falber

[57] ABSTRACT

A lubricant based on a mineral or synthetic oil is stabilized against oxidative degradation by the addition of a mixture comprising at least one specified aromatic amine of the formula I (I)

and at least one sterically hindered amine. The lubricant may contain other antioxidants or other additives. It is preferably used as motor oil.

12 Claims, No Drawings

LUBRICANT COMPOSITION

The present invention relates to lubricant compositions which are stabilized against oxidative degradation. The stabilization is carried out by the addition of at least two specific additives.

SUMMARY OF THE INVENTION

It is known and customary to add additives to lubricants based on mineral or synthetic oils in order to improve their performance characteristics. Additives against oxidative degradation of the lubricants, the so-called antioxidants, are of particular importance. Oxidative degradation of lubricants plays a significant role especially in motor oils because of the high temperatures prevailing in the combustion chambers of the engines and the presence, in addition to oxygen, of oxides of nitrogen ($NO_x$) which act as oxidation catalysts.

Aromatic amines, for example alkylated diphenylamines or alkylated phenothiazines, are used inter alia as antioxidants for lubricants. EP-A-149,422 or GB-A-1,090,688, for example, disclose such amines. The use of such aromatic amines in combination with other antioxidants, for example with triarylphosphites, thiodipropionates or phenolic antioxidants, is also known, for example from EP-A-49,133.

We have found that a combination of aromatic amines with sterically hindered amines is a highly suitable antioxidant for lubricants.

The invention provides a lubricant composition which comprises (A) a mineral or a synthetic base oil or a mixture of such oils, (B) at least one aromatic amine of the formula I or II,

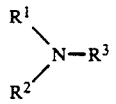

(I)

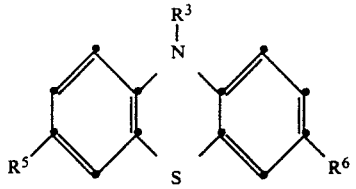

(II)

in which $R^1$ is $C_1$–$C_{18}$alkyl, $C_7$–$C_9$phenylalkyl, $C_5$–$C_{12}$cycloalkyl, phenyl, $C_7$–$C_{18}$alkylphenyl, $C_7$–$C_{18}$alkoxyphenyl or naphthyl, $R^2$ is phenyl, $C_7$–$C_{18}$-alkylphenyl, $C_7$–$C_{18}$alkoxyphenyl or naphthyl, $R^3$ is hydrogen, $C_1$–$C_{12}$alkyl, benzyl, allyl, methallyl, phenyl or a group —$CH_2SR^4$, $R^4$ is $C_4$–$C_{18}$alkyl, —$CH_2COO$($C_4$–$C_{18}$alkyl) or —$CH_2CH_2COO$($C_4$–$C_{18}$alkyl), and $R^5$ and $R^6$ independently of one another are H, $C_1$–$C_{18}$alkyl or $C_7$–$C_9$phenylalkyl, and (C) at least one sterically hindered amine.

DETAILED DESCRIPTION OF THE INVENTION

As $C_1$–$C_{12}$alkyl, $R^3$ may be linear or branched alkyl and may be, for example, methyl, ethyl, propyl, butyl, pentyl, hexyl, octyl, nonyl, decyl or dodecyl. As $C_1$–$C_{18}$alkyl, $R^1$, $R^5$ and $R^6$ may in addition also be, for example, tetradecyl, pentadecyl, hexadecyl or octadecyl. As $C_4$–$C_{18}$alkyl, $R^4$ may also be, for example, n-butyl, tert-butyl, n-hexyl, tert-octyl, n-dodecyl or octadecyl.

As $C_7$–$C_9$phenylalkyl, $R^1$, $R^5$ and $R^6$ may be, for example, benzyl, 2-phenylethyl, α-methylbenzyl, 2-phenylpropyl or α, α-dimethylbenzyl.

As $C_7$–$C_{18}$alkylphenyl, $R^1$ and $R^2$ may have linear or branched alkyl groups. Examples are tolyl, ethylphenyl, isopropylphenyl, tert-butylphenyl, sec-pentylphenyl, n-hexylphenyl, tert-octylphenyl, iso-nonylphenyl or n-dodecylphenyl. $R^1$ and $R^2$ may also be mixtures of alkylphenyl groups, such as those produced in industrial alkylations of diphenylamine with olefins. The alkyl group is preferably in the para position of the aromatic amine.

As the component (B), a compound of the formula I or II is preferably used in which $R^1$ is $C_1$–$C_4$alkyl, $C_7$–$C_9$phenylalkyl, cyclohexyl, phenyl, $C_{10}$–$C_{18}$alkylphenyl or naphthyl, $R^2$ is $C_{10}$–$C_{18}$alkylphenyl or phenyl, $R^3$ is hydrogen, $C_1$–$C_8$alkyl, benzyl, allyl or a group —$CH_2SR^4$, $R^4$ is $C_8$–$C_{18}$alkyl or —$CH_2COO$($C_8$–$C_{18}$alkyl), and $R^5$ and $R^6$ independently of one another are H, $C_1$–$C_{12}$alkyl or $C_7$–$C_9$phenylalkyl.

Of the compounds of the formula I those are particularly preferred in which $R^1$ and $R^2$ independently of one another are phenyl or $C_{10}$–$C_{18}$alkyl-phenyl and $R^3$ is hydrogen.

Of the compounds of the formula II those are particularly preferred in which $R^3$ is hydrogen and $R^5$ and $R^6$ independently of one another are H or $C_4$–$C_{12}$alkyl.

Examples of compounds of the formula I are:

diphenylamine,
N-allyldiphenylamine
4-isopropoxydiphenylamine
N-phenyl-1-naphthylamine
N-phenyl-2-naphthylamine
di-4-methoxyphenylamine
d-[4-(1,3-dimethylbutyl)phenyl]amine
di-[4-(1,1,3,3-tetramethylbutyl)phenyl]amine
tert-octylated N-phenyl-1-naphthylamine
industrial mixtures obtained by reacting diphenylamine with diisobutylene (mono-, di- and trialkylated tert-butyl- and tert-octyldiphenylamine)
phenothiazine
N-allylpenothiazine
3,7-di-tert-octylphenothiazine
industrial mixtures obtained by reacting phenothiazine with diisobutylene Particularly preferred component (B) is 4,4'-di-tert-octyldiphenylamine or 3,7-di-tert-octylphenothiazine or an industrial mixture obtained by reacting diphenylamine with diisobutylene, particularly a mixture which contains the following components:

a) not more than 5% by weight of diphenylamine, b) 8–15% by weight of 4-tert-butyldiphenylamine, c) 24–32% by weight of 4-tert-octyldiphenylamine, 4,4'-di-tert-butyldiphenylamine and 2,4,4'-tri-tert-butyldiphenylamine, d) 23–34% by weight of 4-tert-butyl-4'-tert-octyldiphenylamine, 2,2'- and 3,3'-di-tert-octyldiphenylamine and 2,4-di-tert-butyl-4'-tert-octyldiphenylamine, e) 21–34% by weight of 4,4'-di-tert-octyldiphenylamine and 2,4-di-tert-octyl-4'-tert-butyldiphenylamine.

The component (C) may be any cyclic or acyclic sterically hindered amine. The preferred component (C) is a compound which contains at least one group of the formula III

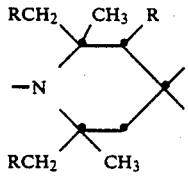

(III)

in which R is hydrogen or methyl. R as hydrogen is preferred. The compounds in question are derivatives of polyalkylpiperidines, particularly of 2,2,6,6-tetramethylpiperidine. These polyalkylpiperidines preferably carry one or two polar substituents or a polar spiro ring system in the 4-position.

The following classes of polyalkylpiperidines are particularly important:

a) compounds of the formula IV

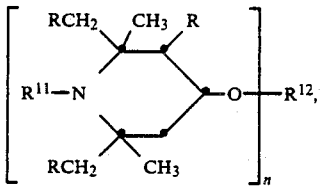

(IV)

in which n is an integer of 1 to 4, preferably 1 or 2, R is hydrogen or methyl, $R^{11}$ is hydrogen, oxyl, hydroxyl, $C_1$–$C_{12}$alkyl, $C_3$–$C_8$alkenyl, $C_3$–$C_8$alkynyl, $C_7$–$C_{12}$aralkyl, $C_1$–$C_{18}$alkoxy, $C_5$–$C_8$cycloalkoxy, $C_7$–$C_9$-phenylalkoxy, $C_1$–$C_8$alkanoyl, $C_3$–$C_5$alkenoyl, $C_1$–$C_{18}$alkanoyloxy, benzyloxy, glycidyl or a group —$CH_2$CH(OH)—Z, in which Z is hydrogen, methyl or phenyl, $R^{11}$ being preferably H, $C_1$–$C_4$alkyl, allyl, benzyl, acetyl or acryloyl and $R^{12}$ being, when n is 1, hydrogen, $C_1$–$C_{18}$alkyl which is uninterrupted or interrupted by one or more oxygen atoms, cyanoethyl, benzyl, glycidyl, a monobasic radical of an aliphatic, cycloaliphatic, araliphatic, unsaturated or aromatic carboxylic acid, carbamic acid or a phosphorus-containing acid or a monovalent silyl radical, preferably a radical of an aliphatic carboxylic acid having 2 to 18 carbon atoms, of a cycloaliphatic carboxylic acid having 7 to 15 carbon atoms, of an $\alpha,\beta$-unsaturated carboxylic acid having 3 to 5 carbon atoms or of an aromatic carboxylic acid having 7 to 15 carbon atoms, $R^{12}$ being, when n is 2, $C_1$–$C_{12}$alkylene, $C_4$–$C_{12}$alkenylene, xylylene, a dibasic radical of an aliphatic, cycloaliphatic, araliphatic or aromatic dicarboxylic acid, dicarbamic acid or a phosphorus-containing acid or a divalent silyl radical, preferably a radical of an aliphatic dicarboxylic acid having 2 to 36 carbon atoms, a cycloaliphatic or aromatic dicarboxylic acid having 8 to 14 carbon atoms or an aliphatic, cycloaliphatic or aromatic dicarbamic acid having 8 to 14 carbon atoms, $R^{12}$ being, when n is 3, a tribasic radical of an aliphatic, cycloaliphatic or aromatic tricarboxylic acid, an aromatic tricarbamic acid or a phosphorus-containing acid or a trivalent silyl radical, and $R^{12}$ being, when n is 4, a tetrabasic radical of an aliphatic, cycloaliphatic or aromatic tetracarboxylic acid.

Any $C_1$–$C_{12}$alkyl substituents present are, for example, methyl, ethyl, n-propyl, n-butyl, sec-butyl, tert-butyl, n-hexyl, n-octyl, 2-ethylhexyl, n-nonyl, n-decyl, n-undecyl or n-dodecyl.

As $C_1$–$C_{18}$alkyl, $R^{11}$ or $R^{12}$ may be, for example, the above groups and additionally, for example, n-tridecyl, n-tetradecyl, n-hexadecyl or n-octadecyl.

As $C_3$–$C_8$alkenyl, $R^{11}$ is, for example, 1-propenyl, allyl, methallyl, 2-butenyl, 2-pentenyl, 2-hexenyl, 2-octenyl and 4-tert-butyl-2-butenyl.

As $C_3$–$C_8$alkynyl, $R^{11}$ is preferably propargyl.

As $C_7$–$C_{12}$aralkyl, $R^{11}$ is particularly phenethyl and above all benzyl.

As $C_1$–$C_8$alkanoyl, $R^{11}$ is , for example, formyl, propionyl, butyryl, octanoyl, but preferably acetyl; and as $C_3$–$C_5$alkenoyl, $R^{11}$ is particularly acryloyl.

As a monobasic radical of a carboxylic acid, $R^{12}$ is a radical, for example, of acetic acid, caproic acid, stearic acid, acrylic acid, methacrylic acid, benzoic acid or $\beta$-(3,5-di-tert-butyl-4-hydroxyphenyl)-propionic acid.

As a dibasic radical of a dicarboxylic acid, $R^{12}$ is a radical, for example, of malonic acid, succinic acid, glutaric acid, adipic acid, suberic acid, sebacic acid, maleic acid, itaconic acid, phthalic acid, dibutylmalonic acid, dibenzylmalonic acid, butyl(3,5-di-tert-butyl-4-hydroxybenzyl)malonic acid or bicycloheptenedicarboxylic acid.

As a tribasic radical of a tricarboxylic acid, $R^{12}$ is a radical, for example, of trimellitic acid, citric acid or nitrilotriacetic acid.

As a tetrabasic radical of a tetracarboxylic acid, $R^{12}$ is the tetrabasic radical, for example, of butane-1,2,3,4-tetracarboxylic acid or of pyromellitic acid.

As a dibasic radical of a dicarbamic acid, $R^{12}$ is a radical, for example, of hexamethylenedicarbamic acid or 2,4-toluylenedicarbamic acid.

Preferred compounds of the formula IV are those in which R is hydrogen, $R^{11}$ is hydrogen or methyl, n is 2 and $R^{12}$ is the diacyl radical of an aliphatic dicarboxylic acid having 4 to 12 carbon atoms.

Examples of polyalkylpiperidine compounds of this class are the following compounds:

1) 4-hydroxy-2,2,6,6-tetramethylpiperidine
2) 1-allyl-4-hydroxy-2,2,6,6-tetramethylpiperidine
3) 1-benzyl-4-hydroxy-2,2,6,6-tetramethylpiperidine
4) 1-(4-tert-butyl-2-butenyl)-4-hydroxy-2,2,6,6-tetramethylpiperidine
5) 4-stearoyloxy-2,2,6,6-tetramethylpiperidine
6) 1-ethyl-4-salicyloyloxy-2,2,6,6-tetramethylpiperidine
7) 4-methacryloyloxy-1,2,2,6,6-pentamethylpiperidine
8) 1,2,2,6,6-pentamethylpiperidin-4-yl-(3,5-di-tert-butyl-4-hydroxyphenyl) propionate
9) di-(1-benzyl-2,2,6,6-tetramethylpiperidin-4-yl) maleate
10) di-(2,2,6,6-tetramethylpiperidin-4-yl) succinate
11) di-(2,2,6,6-tetramethylpiperidin-4-yl) glutarate
12) di-(2,2,6,6-tetramethylpiperidin-4-yl) adipate
13) di-(2,2,6,6-tetramethylpiperidin-4-yl) sebacate
14) di-(1,2,2,6,6-pentamethylpiperdin-4-yl) sebacate
15) di-(1,2,3,6-tetramethyl-2,6-diethylpiperidin-4-yl) sebacate
16) di-(1-allyl-2,2,6,6-tetramethylpiperidin-4-yl) phthalate
17) 1-hydroxy-4-cyanoethyloxy-2,2,6,6-tetramethylpiperidine
18) 1-acetyl-2,2,6,6-tetramethylpiperidin-4-yl acetate
19) tri-(2,2,6,6-tetramethylpiperidin-4-yl) trimellitate
20) 1-acryloyl-4-benzyloxy-2,2,6,6-tetramethylpiperidine
21) di-(2,2,6,6-tetramethylpiperidin-4-yl) diethylmalonate 22) di-(1,2,2,6,6-pentamethylpiperidin-4-yl) dibutylmalonate
23) di-(1,2,2,6,6-pentamethylpiperidin-4-yl) butyl-(3,5-di-tert-butyl-4-hydroxybenzyl) malonate
24) di(1-octyloxy-2,2,6,6-tetramethylpiperidin-4-yl) sebacate
25) di(1-cyclohexyloxy-2,2,6,6-tetramethylpiperidin-4-yl) sebacate
26) hexane-1',6'-bis(4-carbamoyloxy-1-n-butyl-2,2,6,6-tetramethylpiperidine)
27) toluene-2',4'-bis(4-carbamoyloxy-1-n-propyl-2,2,6,6-tetramethylpiperidine)
28) dimethyl-bis(2,2,6,6-tetramethylpiperidin-4-oxy)silane
29) phenyl-tris(2,2,6,6-tetramethylpiperidin-4-oxy)silane
30) tris(1-propyl-2,2,6,6-tetramethylpiperidin-4-yl) phosphite
31) tris(1-propyl-2,2,6,6-tetramethylpiperidin-4-yl) phosphate
32) phenyl[bis-(1,2,2,6,6-pentamethylpiperidin-4-yl)] phosphonate
33) 4-hydroxy-1,2,2,6,6-pentamethylpiperidine
34) 4-hydroxy-N-hydroxyethyl-2,2,6,6-tetramethylpiperidine
35) 4-hydroxy-N-(2-hydroxypropyl)-2,2,6,6-tetramethylpiperidine
36) 1-glycidyl-4-hydroxy-2,2,6,6-tetramethylpiperidine b) compounds of the formula (V)

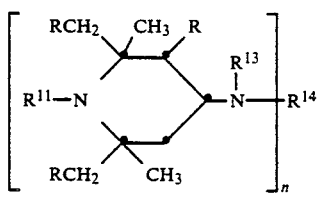

(V)

in which n is the integer 1 or 2, R and $R^{11}$ have the meaning defined in a), $R^{13}$ is hydrogen, $C_1$–$C_{12}$alkyl, $C_2$–$C_5$hydroxyalkyl, $C_5$–$C_7$cycloalkyl, $C_7$–$C_8$aralkyl, $C_2$–$C_{18}$alkanoyl, $C_3$–$C_5$alkenoyl, benzoyl or a group of the formula

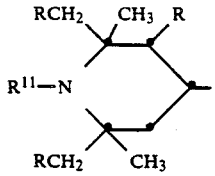

and when n is 1, $R^{14}$ is hydrogen, $C_1$–$C_{18}$alkyl, $C_3$–$C_8$alkenyl, $C_5$–$C_7$cycloalkyl, $C_1$–$C_4$alkyl substituted by a hydroxyl, cyano, alkoxycarbonyl or carbamide group, glycidyl, a group of the formula —$CH_2$—CH(OH)—Z or the formula —CONH—Z, in which Z is hydrogen, methyl or phenyl; when n is 2, $R^{14}$ is $C_2$–$C_{12}$alkylene, $C_6$–$C_{12}$arylene, xylylene, a —$CH_2$—CH(OH)—$CH_2$— group or a —$CH_2$—CH(OH)—$CH_2$—O—D—O— group, in which D is $C_2$–$C_{10}$alkylene, $C_6$–$C_{15}$arylene, $C_6$–$C_{12}$cycloalkylene, or, if $R^{13}$ is not alkanoyl, alkenoyl or benzoyl, $R^{14}$ can also be a dibasic radical of an aliphatic, cycloaliphatic or aromatic dicarboxylic acid or dicarbamic acid or also the group —CO—, or when n is 1, $R^{13}$ and $R^{14}$ together can be the dibasic radical of an aliphatic, cycloaliphatic or aromatic 1,2- or 1,3-di-carboxylic acid.

Any $C_1$–$C_{12}$alkyl or $C_1$–$C_{18}$alkyl substituents present have the meaning already defined in a).

Any $C_5$–$C_7$cycloalkyl substituents present are particularly cyclohexyl.

As $C_7$–$C_8$aralkyl, $R^{13}$ is particularly phenylethyl or above all benzyl. As $C_2$–$C_5$hydroxyalkyl, $R^{13}$ is particularly 2-hydroxyethyl or 2-hydroxypropyl.

As $C_2$–$C_{18}$alkanoyl, $R^{13}$ is for example propionyl, butyryl, octanoyl, dodecanoyl, hexadecanoyl, octadecanoyl, but preferably acetyl, and as $C_3$–$C_5$alkenoyl, $R^{13}$ is particularly acryloyl.

As $C_2$–$C_8$alkenyl, $R^{14}$ is for example allyl, methallyl, 2-butenyl, 2-pentenyl, 2-hexenyl or 2-octenyl.

As $C_1$–$C_4$alkyl substituted by a hydroxyl, cyano, alkoxycarbonyl or carbamide group, $R^{14}$ can be, for example, 2-hydroxyethyl, 2-hydroxypropyl, 2-cyanoethyl, methoxycarbonylmethyl, 2-ethoxycarbonylethyl, 2-aminocarbonylpropyl or 2-(dimethylaminocarbonyl-)ethyl.

Any $C_2$–$C_{12}$alkylene substituents present are, for example, ethylene, propylene, 2,2-dimethylpropylene, tetramethylene, hexamethylene, octamethylene, decamethylene or dodecamethylene.

Any $C_6$–$C_{15}$arylene substituents present are, for example, o-, m- or p-phenylene, 1,4-naphthylene or 4,4'-diphenylene.

As $C_6$–$C_{12}$cycloalkylene, D is especially cyclohexylene.

Preferred compounds of the formula V are those in which n is 1 or 2, R is hydrogen, $R^{11}$ is hydrogen or methyl, $R^{13}$ is hydrogen, $C_1$–$C_{12}$alkyl or a group of the formula

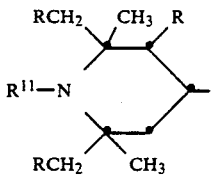

and when n=1, $R^{14}$ is hydrogen or $C_1$–$C_{12}$alkyl, and when n=2, $R^{14}$ is $C_2$–$C_8$alkylene.

Examples of polyalkylpiperidine compounds of this class are the following compounds:

37) N,N'-bis(2,2,6,6-tetramethylpiperidin-4-yl)hexamethylene-1,6-diamine
38) N,N'-bis(2,2,6,6-tetramethylpiperidin-4-yl)hexamethylene-1,6-diacetamide
39) bis(2,2,6,6-tetramethylpiperidin-4-yl)amine
40) 4-benzoylamino-2,2,6,6-tetramethylpiperidine
41) N,N'-bis(2,2,6,6-tetramethylpiperidin-4-yl)-N,N'-dibutyladipamide
42) N,N'-bis(2,2,6,6-tetramethylpiperidin-4-yl)-N,N'-dicyclohexyl-2-hydroxypropylene-1,3-diamine
43) N,N'-bis(2,2,6,6-tetramethylpiperidin-4-yl)-p-xylylenediamine
44) N,N'-bis(2,2,6,6-tetramethylpiperidin-4-yl)succindiamide
45) di(2,2,6,6-tetramethylpiperidin-4-yl) N-(2,2,6,6-tetramethylpiperidin-4-yl)-aminodipropionate
46) The compound of the formula

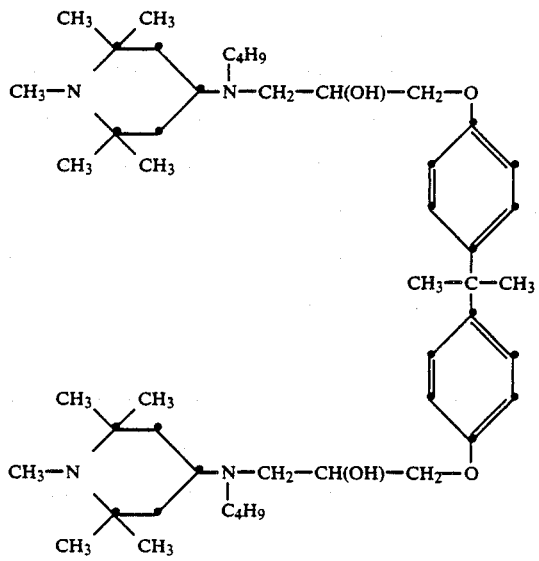

47) 4-(bis-2-hydroxyethylamino)-1,2,2,6,6-pentamethylpiperidine 48) 4-(3-methyl-4-hydroxy-5-tert-butylbenzoamido)-2,2,6,6-tetramethylpiperidine 49) 4-methacrylamido-1,2,2,6,6-pentamethylpiperidine c) compounds of the formula (VI)

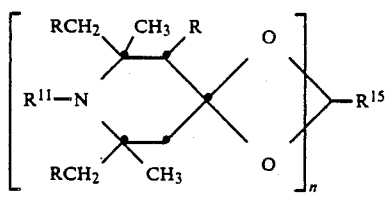

(VI)

in which n is the integer 1 or 2, R and $R^{11}$ have the meaning defined in a), and when n is 1, $R^{15}$ is $C_2$-$C_8$alkylene or $C_2$-$C_8$hydroxyalkylene or $C_4$-$C_{22}$acyloxyalkylene, and when n is 2, $R^{15}$ is the group $(—CH_2)_2C(CH_2—)_2$.

As $C_2$-$C_8$alkylene or $C_2$-$C_8$hydroxyalkylene, $R^{15}$ is for example ethylene, 1-methylethylene, propylene, 2-ethylpropylene or 2-ethyl-2-hydroxymethylpropylene.

As $C_4$-$C_{22}$acyloxyalkylene, $R^{15}$ is for example 2-ethyl-2-acetoxymethylpropylene.

Examples of polyalkylpiperidine compounds of this class are the following compounds:

50) 9-aza-8,8,10,10-tetramethyl-1,5-dioxaspiro[5.5]undecane 51) 9-aza-8,8,10,10-tetramethyl-3-ethyl-1,5-dioxaspiro[5.5]undecane 52) 8-aza-2,7,7,8,9,9-hexamethyl-1,4-dioxaspiro[4.5]decane 53) 9-aza-3-hydroxymethyl-3-ethyl-8,8,9,10,10-pentamethyl-1,5-dioxaspiro[5.5]undecane 54) 9-aza-3-ethyl-3-acetoxymethyl-9-acetyl-8,8,10,10-tetramethyl-1,5-dioxaspiro[5.5]undecane 55) 2,2,6,6-tetramethylpiperidine-4-spiro-2'-(1',3'-dioxan)-5'-spiro-5''-(1'',3''-dioxan)-2''-spiro-4'''-(2''',2''',6''',6'''-tetramethylpiperidine).

d) compounds of the formulae VIIA, VIIB and VIIC

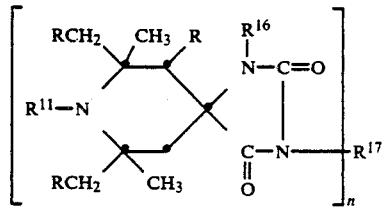

(VIIA)

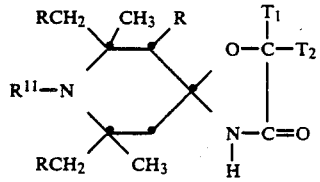

(VIIB)

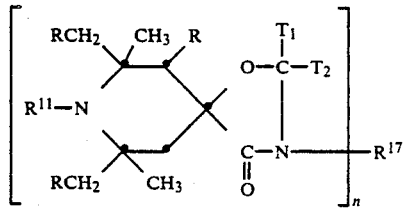

(VIIC)

in which n is the integer 1 or 2, R and $R^{11}$ have the meaning defined in a), $R^{16}$ is hydrogen, $C_1$-$C_{12}$alkyl, allyl, benzyl, glycidyl or $C_2$-$C_6$alkoxyalkyl, and when n is 1, $R^{17}$ is hydrogen, $C_1$-$C_{12}$alkyl, $C_3$-$C_5$alkenyl, $C_7$-$C_9$aralkyl, $C_5$-$C_7$cycloalkyl, $C_2$-$C_4$hydroxyalkyl, $C_2$-$C_6$alkoxyalkyl, $C_6$-$C_{10}$aryl, glycidyl or a group of the formula $—(CH_2)p—COO—Q$ or the formula $—(CH_2)p—O—CO—Q$, in which p is 1 or 2 and Q is $C_1$-$C_4$alkyl or phenyl, and when n is 2, $R^{17}$ is $C_2$-$C_{12}$alkylene, $C_4$-$C_{12}$alkenylene, $C_6$-$C_{12}$arylene, a group $—CH_2—CH(OH)—CH_2—O—D—O—CH_2—CH(OH)—CH_2—$, in which D is $C_2$-$C_{10}$alkylene, $C_6$-$C_{15}$arylene, $C_6$-$C_{12}$cycloalkylene or a group $—CH_2CH(OZ')CH_2—(OCH_2CH(OZ')CH_2)_2—$, in which Z' is hydrogen, $C_1$-$C_{18}$alkyl, allyl, benzyl, $C_2$-$C_{12}$alkanoyl or benzoyl, $T_1$ and $T_2$ independently of one another are hydrogen, $C_1$-$C_{18}$alkyl or $C_6$-$C_{10}$aryl or $C_7$-$C_9$aralkyl which are unsubstituted or substituted by halogen or $C_1$-$C_4$alkyl, or $T_1$ and $T_2$ together form with the carbon atom connecting them a $C_5$-$C_{12}$cycloalkane ring.

Any $C_1$-$C_{12}$alkyl substituents present are, for example, methyl, ethyl, n-propyl, n-butyl, sec-butyl, tert-butyl, n-hexyl, n-octyl, 2-ethylhexyl, n-nonyl, n-decyl, n-undecyl or n-dodecyl.

Any $C_1$-$C_{18}$alkyl substituents present can be, for example, the groups defined above and additionally also, for example, n-tridecyl, n-tetradecyl, n-hexadecyl or n-octadecyl.

Any $C_2$-$C_6$alkoxyalkyl substituents present are, for example, methoxymethyl, ethoxymethyl, propoxymethyl, tert-butoxymethyl, ethoxyethyl, ethoxypropyl, n-butoxyethyl, tert-butoxyethyl, isopropoxyethyl or propoxypropyl.

As $C_3$-$C_5$alkenyl, $R^{17}$ is, for example, 1-propenyl, allyl, methallyl, 2-butenyl or 2-pentenyl.

As $C_7$-$C_9$aralkyl, $R^{17}$, $T_1$ and $T_2$ are particularly phenethyl or above all benzyl. Any cycloalkane ring formed by $T_1$ and $T_2$ together with the carbon atom can be, for example, a cyclopentane, cyclohexane, cyclooctane or cyclododecane ring.

As $C_2$–$C_4$hydroxyalkyl, $R^{17}$ is, for example, 2-hydroxyethyl, 2-hydroxypropyl, 2-hydroxybutyl or 4-hydroxybutyl.

As $C_6$–$C_{10}$aryl, $R^{17}$, $T_1$ and $T_2$ are especially phenyl, α- or β-naphthyl which are unsubstituted or substituted by halogen or $C_1$–$C_4$alkyl.

As $C_2$–$C_{12}$alkylene, $R^{17}$ is, for example, ethylene, propylene, 2,2-dimethylpropylene, tetramethylene, hexamethylene, octamethylene, decamethylene or dodecamethylene.

As $C_4$–$C_{12}$alkenylene, $R^{17}$ is particularly 2-butenylene, 2-pentenylene or 3-hexenylene.

As $C_6$–$C_{12}$arylene, $R^{17}$ is, for example, o-, m- or p-phenylene, 1,4-naphthylene or 4,4'-diphenylene.

As $C_2$–$C_{12}$alkanoyl, Z' is, for example, propionyl, butyryl, octanoyl, dodecanoyl, but preferably acetyl.

As $C_2$–$C_{10}$alkylene, $C_6$–$C_{15}$arylene or $C_6$–$C_{12}$cycloalkylene, D has the meaning defined in b).

Examples of polyalkylpiperidine compounds of this class are the following compounds:

56) 3-benzyl-1,3,8-triaza-7,7,9,9-tetramethylspiro[4.5]-decane-2,4-dione
57) 3-n-octyl-1,3,8-triaza-7,7,9,9-tetramethylspiro[4.5]-decane-2,4-dione
58) 3-allyl-1,3,8-triaza-1,7,7,9,9-pentamethylspiro[4.5]-decane-2,4-dione
59) 3-glycidyl- 1,3,8-triaza-7,7,8,9,9-pentamethyl-spiro[4.5]decane-2,4-dione
60) 1,3,7,7,8,9,9-heptamethyl-1,3,8-triazaspiro[4.5]decane-2,4-dione
61) 2-iso-propyl-7,7,9,9-tetramethyl-1-oxa-3,8-diaza-4-oxo-spiro[4.5]-decane
62) 2,2-dibutyl-7,7,9,9-tetramethyl-1-oxa-3,8-diaza-4-oxospiro[4.5]decane
63) 2,2,4,4-tetramethyl-7-oxa-3,20-diaza-21-oxodispiro 5.1.11.2]-heneicosane
64) 2-butyl-7,7,9,9-tetramethyl-1-oxa-4,8-diaza-3-oxospiro[4.5]decane
65) 8-acetyl-3-dodecyl-1,3,8-triaza-7,7,9,9-tetramethyl-spiro[4.5]decane-2,4-dione or the compounds of the following formulae:

66)

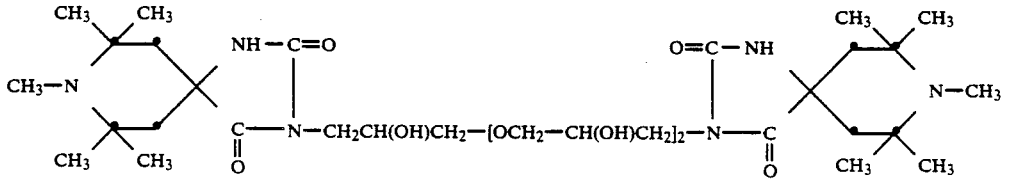

67)

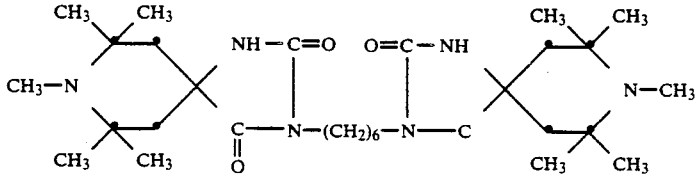

68)

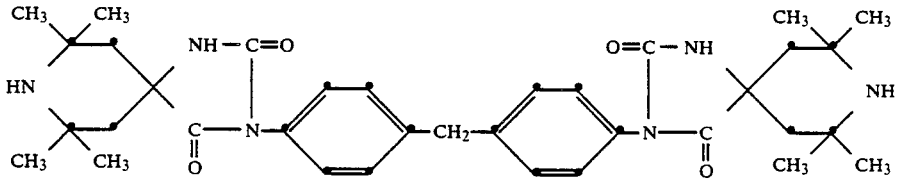

69)

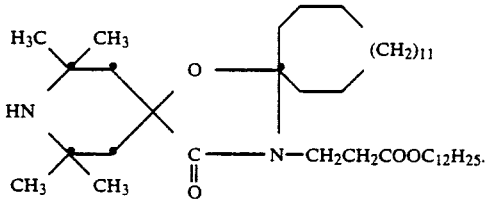

e) compounds of the formula VIII (VIII)

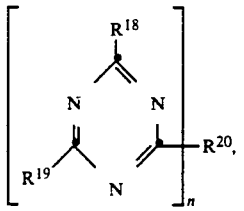

in which n is the integer 1 or 2 and $R^{18}$ is a group of the formula

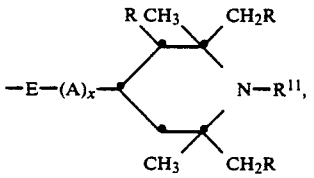

in which R and $R^{11}$ have the meaning defined in a), E is —O— or —$NR^{11}$—, A is $C_2$–$C_6$alkylene or —$(CH_2)_3$—O—, and x is the integers 0 or 1, $R^{19}$ is the same as $R^{18}$ or is one of the groups $—NR^{21}R^{22}$, $—OR^{23}$, $—NHCH_2OR^{23}$ or $—N(CH_2OR^{23})_2$, and when n is 1, $R^{20}$ is the same as $R^{18}$ or $R^{19}$, and when n=2, $R^{20}$ is a group —E—B—E—, in which B is $C_2$–$C_6$alkylene which is uninterrupted or interrupted by $—N(R^{21})—$, $R^{11}$ is $C_1$–$C_{12}$alkyl, cyclohexyl, benzyl or $C_1$–$C_4$hydroxyalkyl or a group of the formula

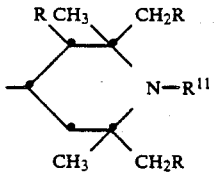

$R^{22}$ is $C_1$–$C_{12}$alkyl, cyclohexyl, benzyl, $C_1$–$C_4$hydroxyalkyl, and $R^{23}$ is hydrogen, $C_1$–$C_{12}$alkyl or phenyl, or $R^{21}$ and $R^{22}$ together are $C_4$–$C_5$-alkylene or $C_4$–$C_5$oxaalkylene, for example

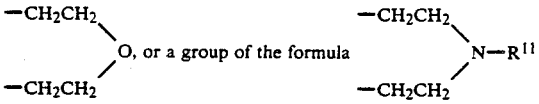

or $R^{21}$ and $R^{22}$ in each case are also a group of the formula

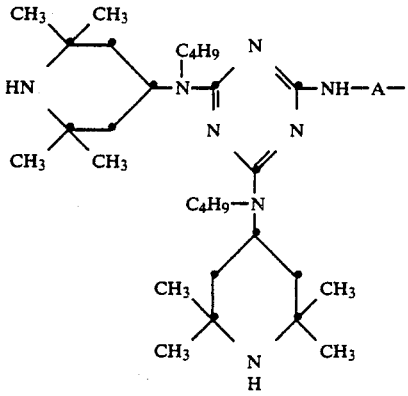

Any $C_1$–$C_{12}$alkyl substituents present are, for example, methyl, ethyl, n-propyl, n-butyl, sec-butyl, tert-butyl, n-hexyl, n-octyl, 2-ethylhexyl, n-nonyl, n-decyl, n-undecyl or n-dodecyl.

Any $C_1$–$C_4$hydroxyalkyl substituents present are, for example, 2-hydroxyethyl, 2-hydroxypropyl, 3-hydroxypropyl, 2-hydroxybutyl or 4-hydroxybutyl.

$C_2$–$C_6$alkylene as A is, for example, ethylene, propylene, 2,2-dimethylpropylene, tetramethylene or hexamethylene.

$C_4$–$C_5$alkylene or $C_4$–$C_5$oxaalkylene as $R^{21}$ and $R^{22}$ together are, for example, tetramethylene, pentamethylene or 3-oxapentamethylene.

Examples of polyalkylpiperidine compounds of this class are the compounds of the following formulae:

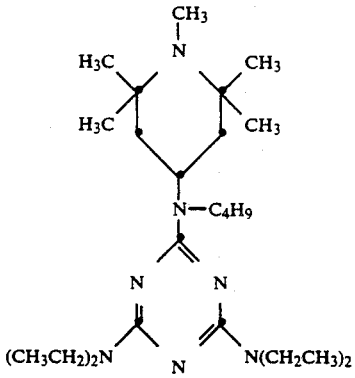

70)

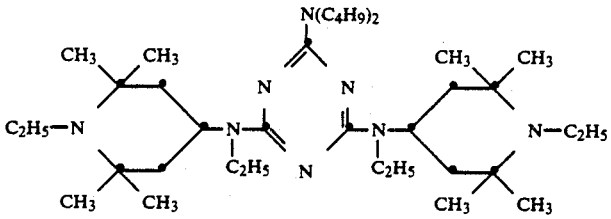

71)

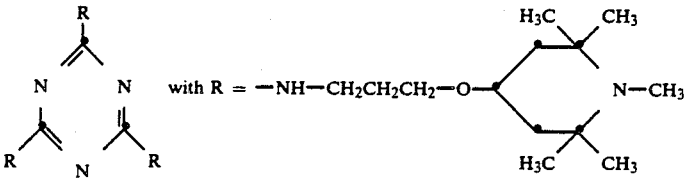

72)

-continued
73)
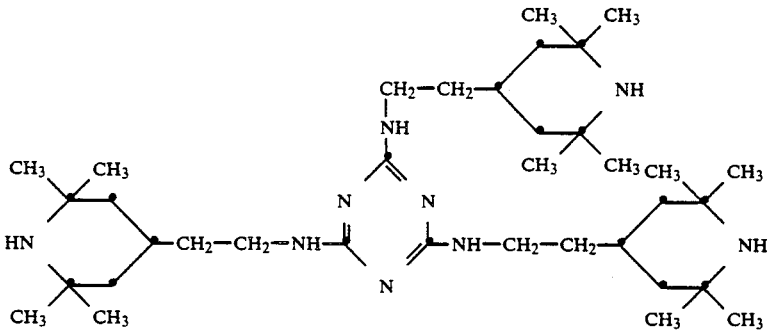
74)
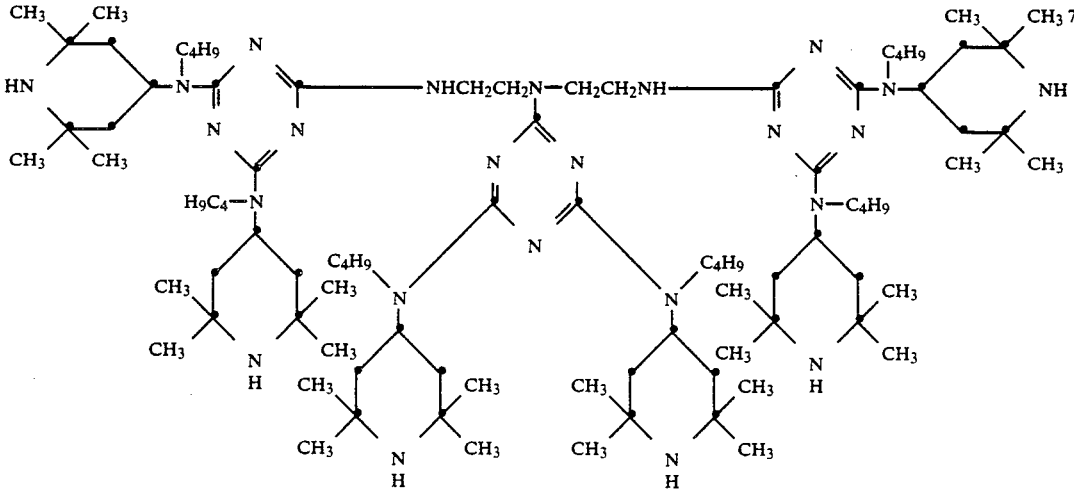
75)
R—NH—(CH2)3—N(R)—(CH2)2—N(R)—(CH2)3—NH—R with R =
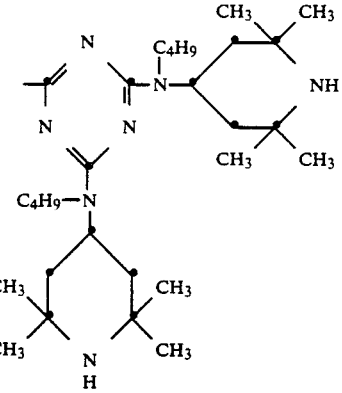
76)
R—NH—(CH2)3—N(R)—(CH2)2—N(R)—(CH2)3—NH—R with R =
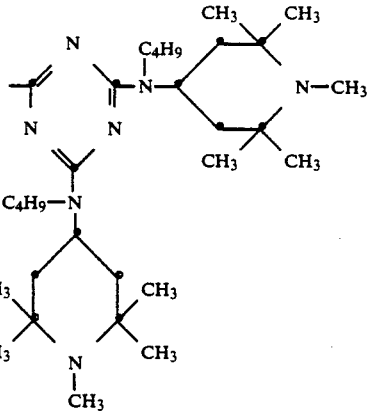

-continued
77)
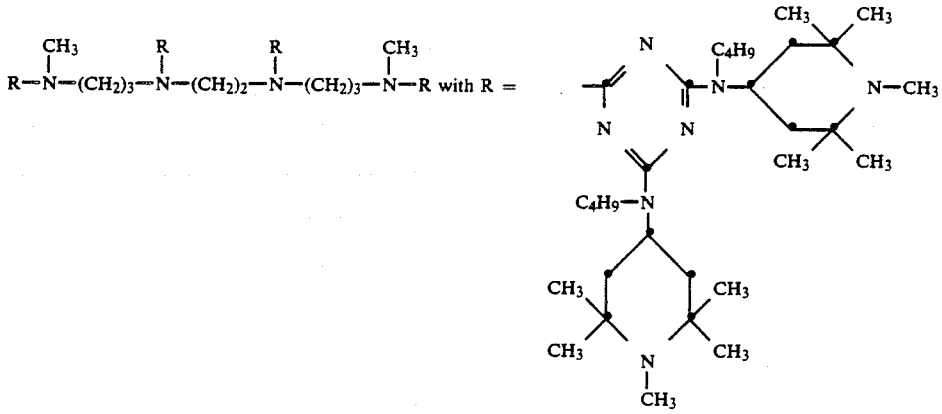
78)
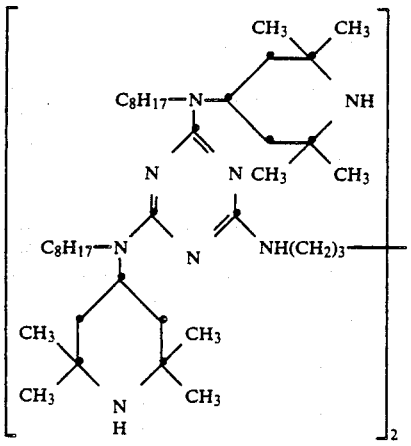
79)
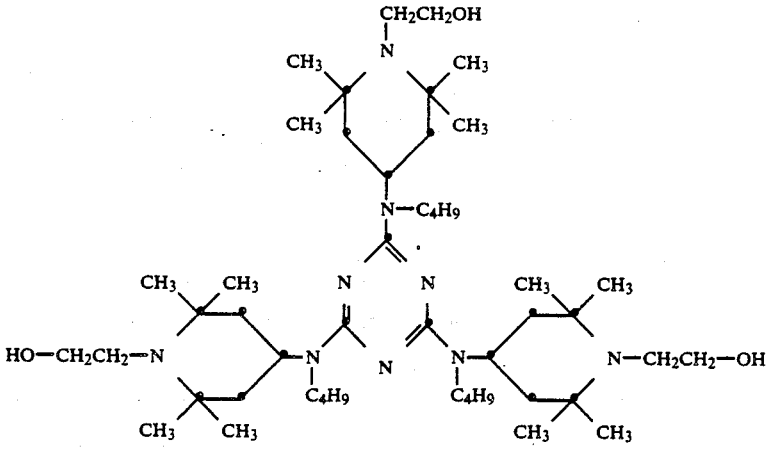

-continued (80)

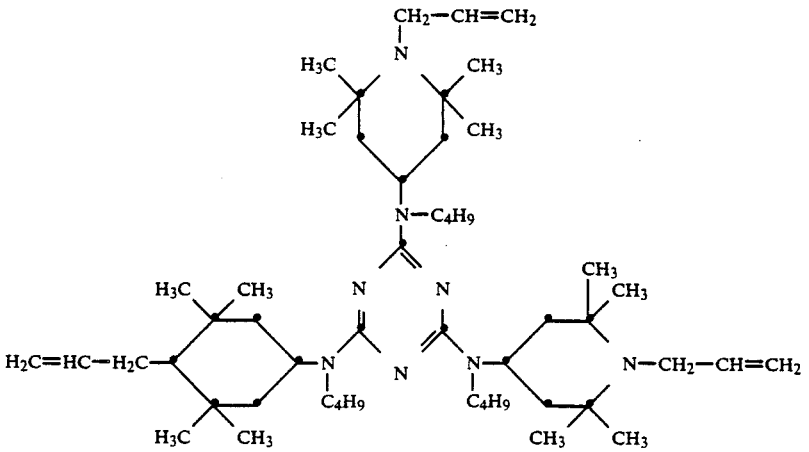

f) oligomers or polymeric compounds whose recurring structural unit comprises a 2,2,6,6-tetraalkylpiperidine radical of the formula (I), particularly polyesters, polyethers, polyamides, polyamines, polyurethanes, polyureas, polyaminotriazines, poly(meth)acrylates, poly(meth)acrylamide and their copolymers which comprise such radicals.

Examples of 2,2,6,6-polyalkylpiperidine light stabilizers of this class are the compounds of the following formulae where m is an integer of 2 to about 200.

81)

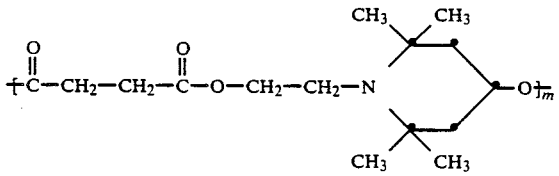

82)

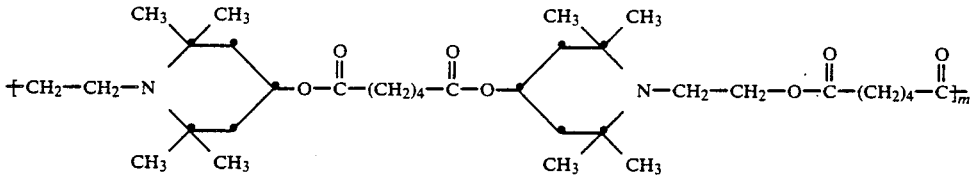

83)

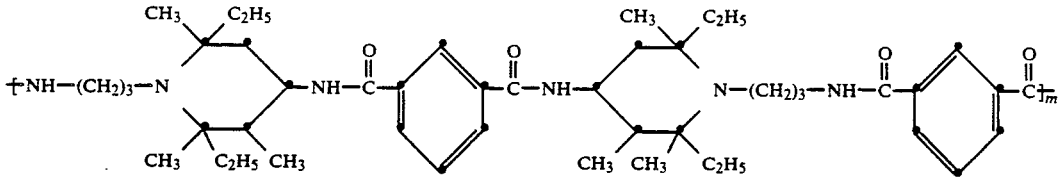

84)

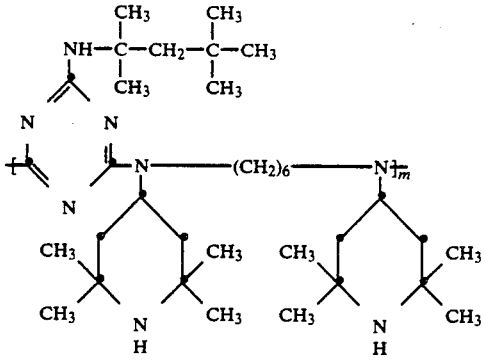

-continued
85)
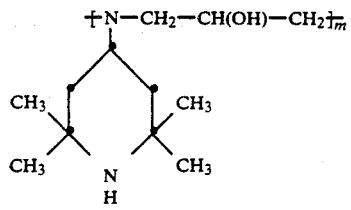
86)
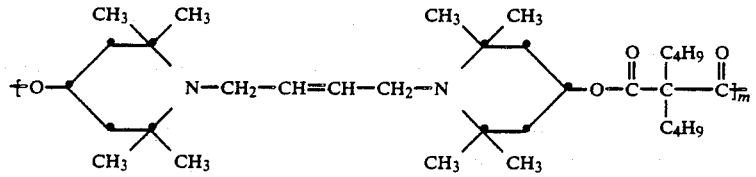
87)
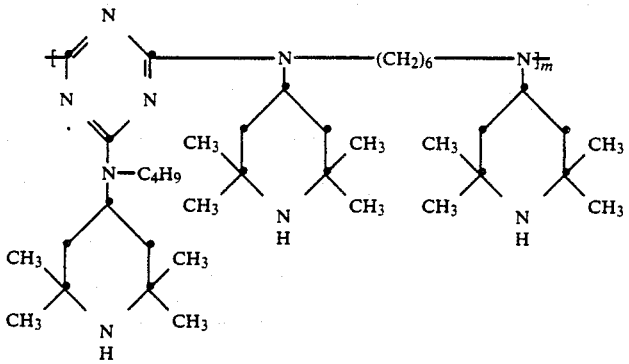
88)
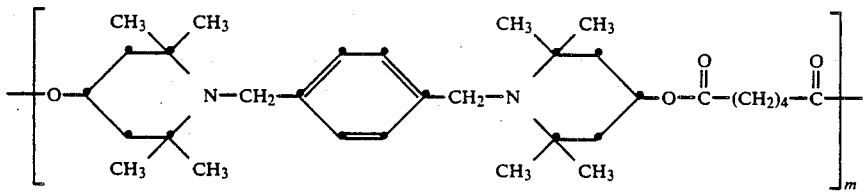
89)
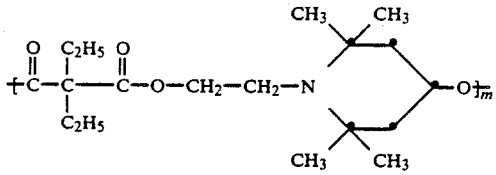
90)
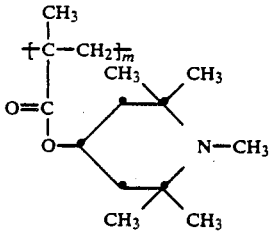
91)
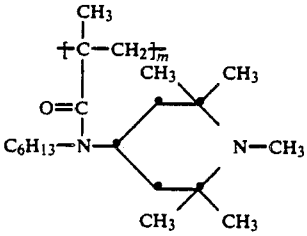

-continued

92)

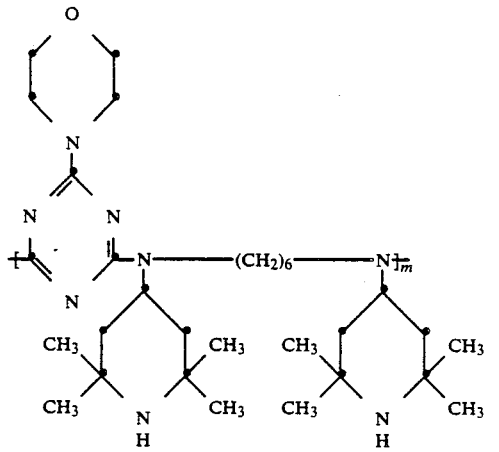

93)

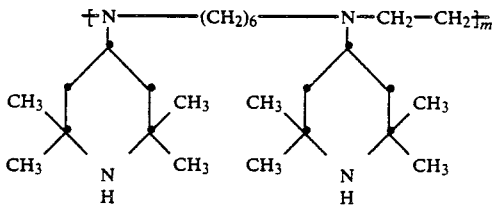

94)

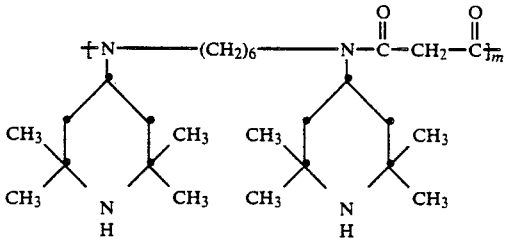

(IX)

g) compounds of the formula IX $R^{11}$—N

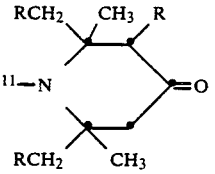

in which R and $R^{11}$ have the meaning defined in a).

Preferred compounds of the formula IX are those in which R is hydrogen or methyl and $R^{11}$ is hydrogen or methyl.

Examples of such compounds are:

95) 2,2,6,6-tetramethyl-4-piperidone (triacetonamine)
96) 1,2,2,6,6-pentamethyl-4-piperidone
97) 2,2,6,6-tetramethyl-4-piperidon-1-oxyl
98) 2,3,6-trimethyl-2,6-diethyl-4-piperidone The amount of (B) and (C) added to the base oil (A) depends on the type of the base oil and the desired degree of stabilization. Generally the total of (B) and (C) is 0.1 to 2% by weight, preferably 0.5 to 1% by weight, based on (A). The ratio of (B) to (C) can vary within wide limits; (B) is generally the quantitatively dominant component. The ratio (B):(C) is preferably 3–5:1.

The component (A) is a mineral or synthetic base oil, such as is normally used for the production of lubricants. Synthetic oils may be, for example, esters of polycarboxylic acids or of polyols; they may also be aliphatic polyesters or poly-α-olefins, silicones, phosphoric acid esters or polyalkylene glycols. The lubricant may also be a grease based on an oil and a thickener. Such lubricants are described, for example, in D. Klamann "Schmierstoffe und artverwandte Produkte" ["Lubricants and Related Products"], Verlag Chemie, Weinheim 1982.

The lubricant may additionally contain other additives, for example other antioxidants, metal passivators, rust inhibitors, viscosity index improvers, pour point depressants, dispersants, surfactants or antiwear additives.

EXAMPLES OF PHENOLIC ANTIOXIDANTS

1. Alkylated Monophenolics 2,6-di-tert-butyl-4-methylphenol, 2,6-di-tert-butylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-iso-butylphenol, 2,6-dicyclopentyl-4-methylphenol, 2-(α-methylcyclohexyl)-4,6-dimethylphenol, 2,6-dioctadecyl-4-methylphenol, 2,4,6-tricyclohexylphenol, 2,6-di-tert-butyl-4-methoxymethylphenol, o-tert-butylphenol.

2. Alkylated Hydroquinones 2,6-di-tert-butyl-4-methoxyphenol, 2,5-di-tert-butylhydroquinone, 2,5-di-tert-amylhydroquinone, 2,6-diphenyl-4-octadecyloxyphenol.

3. Hydroxylated Thiodiphenyl Ethers 2,2'-thio-bis(6-tert-butyl-4-methylphenol), 2,2'-thio-bis(4-octylphenol), 4,4'-thio-bis(6-tert-butyl-3-methylphenol), 4,4'-thio-bis(6-tert-butyl-2-methylphenol).

4. Alkylidene Bisphenols 2,2'-methylene-bis(6-tert-butyl-4-methylphenol), 2,2'-methylene-bis(6-tert-butyl-4-ethylphenol), 2,2'-methylene-bis[4-methyl-6-(?-methylcyclohexyl)phenol], 2,2'-methylene-bis(4-methyl-6-cyclohexylphenol), 2,2'-methylene-bis(6-nonyl-4-methylphenol), 2,2'-methylene-bis(4,6-di-tert-butylphenol), 2,2'-ethylidene-bis(4,6-di-tert-butylphenol), 2,2'-ethylidene-bis(6-tert-butyl-4-isobutylphenol or -5-isobutylphenol), 2,2'-methylene-bis[6-(α-methylbenzyl)-4-nonylphenol], 2,2'-methylene-bis[6-(α,α-dimethylbenzyl)-4-nonylphenol], 4,4'-methylene-bis(2,6-di-tert-butylphenol), 4,4'-methylene-bis(6-tert-butyl-2-methylphenol), 1,1-bis(5-tert-butyl-4-hydroxy-2-methylphenyl)butane, 2,6-di(3-tert-butyl-5-methyl-2-hydroxybenzyl)-4-methylphenol, 1,1,3-tris(5-tert-butyl-4-hydroxy-2-methylphenyl)-3-n-dodecylmercaptobutane, ethylene glycol bis[3,3-bis(3'-tert-butyl-4'-hydroxyphenyl)butyrate], bis(3-tert-butyl-4-hydroxy-5-methylphenyl)dicyclopentadiene, bis[2-(3'-tert-butyl-2'-hydroxy-5'-methylbenzyl)-6-tert-butyl-4-methylphenyl]terephthalate.

5. Benzyl Compounds 1,3,5-tris(3,5-di-tert-butyl-4-hydroxybenzyl)-2,4,6-trimethylbenzene, bis(3,5-di-tert-butyl-4-hydroxybenzyl) sulfide, isooctyl 3,5-di-tert-butyl-4-hydroxybenzylmercaptoacetate, bis(4-tert-butyl-3-hydroxy-2,6-dimethylbenzyl)dithiol terephthalate, 1,3,5-tris(3,5-di-tert-butyl-4-hydroxybenzyl) isocyanurate, 1,3,5-tris(4-tert-butyl-3-hydroxy-2,6-dimethylbenzyl) isocyanurate, dioctadecyl 3,5-di-tert-butyl-4-hydroxybenzylphosphonate, monoethyl 3,5-di-tert-butyl-4-hydroxybenzylphosphonate calcium salt.

6. Acylaminophenols 4-hydroxylauranilide, 4-hydroxystearanilide, 2,4-bis-octylmercapto-6-(3,5-di-tert-butyl-4-hydroxyanilino)-s-triazine, octyl N-(3,5-di-tert-butyl-4-hydroxyphenyl)-carbamate.

7. Esters of
β-(3,5-di-tert-butyl-4-hydroxyphenyl)propionic acid with monohydric or polyhydric alcohols, for example with methanol, diethylene glycol, octadecanol, triethylene glycol, 1,6-hexanediol, pentaerythritol, neopentyl glycol, trishydroxyethyl isocyanurate, thiodiethylene glycol, bishydroxyethyloxalic acid diamide.

8. Esters of
β-(5-tert-butyl-4-hydroxy-3-methylphenyl)propionic acid with monohydric or polyhydric alcohols, for example with methanol, diethylene glycol, octadecanol, triethylene glycol, 1,6-hexanediol, pentaerythritol, neopentyl glycol, tris-hydroxyethyl isocyanurate, thiodiethylene glycol, dihydroxyethyloxalic acid diamide.

9. Amides of
β-(3,5-di-tert-butyl-4-hydroxyphenyl)propionic acid for example N,N'-bis(3,5-di-tert-butyl-4-hydroxyphenylpropionyl)hexamethylenediamine, N,N'-bis(3,5-di-tert-butyl-4-hydroxyphenylpropionyl)trimethylenediamine, N,N'-bis(3,5-di-tert-butyl-4-hydroxyphenylpropionyl)hydrazine.

EXAMPLES OF OTHER ANTIOXIDANTS aliphatic or aromatic phosphites, esters of thiodipropionic acid or of thiodiacetic acid, or salts of dithiocarbamide acid or dithiophosphoric acid.

EXAMPLES OF METAL DEACTIVATORS FOR EXAMPLE FOR COPPER triazoles, benzotriazoles and their derivatives, tolutriazoles and their derivatives, 2-mercaptobenzothiazole, 2-mercaptobenzotriazole, 2,5-dimercaptobenzotriazole, 2,5-dimercaptobenzothiadiazole, 5,5'-methylenebisbenzotriazole, 4,5,6,7-tetrahydrobenzotriazole, salicylidenepropylenediamine, salicylaminoguanidine and their salts.

EXAMPLES OF RUST INHIBITORS a) Organic acids and esters, metal salts and anhydrides thereof, for example: N-oleoylsarcosine, sorbitol monooleate, lead naphthenate, alkenylsuccinic anhydride, for example dodecenylsuccinic anhydride, alkenylsuccinic acid hemiesters and hemi-amides, and 4-nonylphenoxyacetic acid.

b) Nitrogenous compounds, for example:

I. primary, secondary or tertiary aliphatic or cycloaliphatic amines and amine salts of organic and inorganic acids, for example oil-soluble alkylammonium carboxylates.

II. heterocyclic compounds, for example: substituted imidazolines and oxazolines.

c) Phosphorus compounds, for example: amine salts of partial esters of phosphoric acid or partial esters of phosphonic acid, zinc dialkyldithiophosphates.

d) Sulfur compounds, for example: barium dinonylnaphthalenesulfonates, calcium petroleum sulfonates.

EXAMPLES OF VISCOSITY INDEX IMPROVERS polyacrylates, polymethacrylates, vinylpyrrolidone/methacrylate copolymers, polyvinylpyrrolidones, polybutenes, olefin copolymers, styrene/acrylate copolymers, polyethers.

EXAMPLES OF POUR POINT DEPRESSANTS polymethacrylate, alkylated naphthalene derivatives.

EXAMPLES OF DISPERSANTS/SURFACTANTS polybutenylsuccinamides or -imides, polybutenylphosphonic acid derivatives, basic magnesium, calcium and barium sulfonates and phenolates.

EXAMPLES OF ANTIWEAR ADDITIVES compounds containing sulfur and/or phosphorus and/or halogen, such as sulfurized vegetable oils, zinc dialkyldithiophosphates, tritolylphosphate, chlorinated paraffins, alkyl sulfides, aryl disulfides and aryl trisulfides, triphenylphosphorothionates, diethanolaminomethyltolyltriazole, di(2-ethylhexyl)aminomethyltolyltriazole.

The addition of phenolic antioxidants and/or of aliphatic and aromatic phosphites or phosphonites which are capable of increasing the stabilizing effect of the components (B) and (C), is particularly important.

Examples of suitable phosphites and phosphonites are: triphenyl phosphite, decyldiphenyl phosphite, phenyldidecyl phosphite, tris(nonylphenyl) phosphite, trilauryl phosphite, trioctadecyl phosphite, distearylpentaerythritol diphosphite, tris(2,4-di-tert-butylphenyl) phosphite, diisodecylpentaerythritol diphosphite, bis(2,4-di-tert-butylphenyl)pentaerythritol diphosphite, tristearylsorbitol triphosphite, tetrakis(2,4-d-tert-butylphenyl)-4,4'-biphenylene diphosphonite, bis(2,6-di-tert-butyl-4-methylphenyl)pentaerythritol diphosphite.

The individual additives are dissolved in the oil. To speed up the dissolution, the oil may be first heated or the additives may be first dissolved in a solvent.

The lubricant may also contain solid lubricant additives, for example graphite or molybdenum sulfide.

The examples below elucidate the invention in greater detail. The parts and percentages are parts and percentages by weight, unless stated otherwise.

EXAMPLE 1

The induction period of the oxidation of the oil samples by air containing 400 ppm of $NO_2$ is determined under isothermal conditions using a differential scanning calorimeter (Du Pont Thermoanalysator 1090). The measurement is carried out at 170° C. at a pressure of 8 bar. A reference mineral oil (Aral 136) containing 1% by volume of 1-decene added in order to boost its susceptibility to oxidation, is used as the base oil. The following amine stabilizers are added to the oil.

Aromatic Amines

A-1 An industrial mixture produced by reacting diphenylamine with diisobutylene, comprising a) 3% of diphenylamine
b) 14% of 4-tert-butyldiphenylamine,
c) 30% of 4-tert-octyldiphenylamine, 4,4'-di-tert-butyldiphenylamine and 2,4,4'-tri-tert-butyldiphenylamine,
d) 29% of 4-tert-butyl-4'-tert-octyldiphenylamine, 2,2'- and 3,3'-di-tert-octyldiphenylamine and 2,4-di-tert-butyl-4'-tert-octyldiphenylamine,
e) 18% of 4,4'-di-tert-octyldiphenylamine,
f) 6% of 2,4-di-tert-octyl-4'-tert-butyldiphenylamine.

A-2 3,7-di-(tert-octyl)phenothiazine

Hindered Amines

H-1 di(2,2,6,6-tetramethylpiperidin-4-yl) sebacate
H-2 2,2,6,6-tetramethyl-4-piperidone
H-3 di(2,2,6,6-tetramethylpiperidin-4-yl) succinate
H-4 di(1,2,2,6,6-pentamethylpiperidin-4-yl) sebacate
H-5 2,3,6-trimethyl-2,6-diethyl--piperidone
H-6 2,2,6,6-tetramethyl-4-butylaminopiperidine Table 1 lists the induction periods. The higher the induction period, the greater is the antioxidative effect of the stabilizer additives.

TABLE 1

| Aromatic amine | Hindered amine | Induction period (min) |
|---|---|---|
| — | — | 43 |
| 0.55% of A-1 | — | 80 |
| 0.45% of A-1 | 0.10% of H-1 | 91.5 |
| 0.45% of A-1 | 0.10% of H-2 | 91.5 |
| 0.45% of A-1 | 0.10% of H-3 | 90.05 |
| 0.45% of A-1 | 0.10% of H-4 | 90 |
| 0.45% of A-1 | 0.10% of H-5 | 84.5 |
| 0.45% of A-1 | 0.10% of H-6 | 89 |

EXAMPLE 2

Oxidation of hydrocarbons gives rise to oxygen-containing groups, for example hydroxyl, carboxyl or ester groups. Infra-red spectroscopy allows the amount of such groups to be measured and to determine therefrom the effect of the antioxidants. For this purpose samples of a reference mineral oil (Aral® 136) containing 1% by volume of 1-decene added in order to boost its susceptibility to oxidation, is heated under isothermal conditions in air containing 400 ppm of $NO_2$, for 12 hours at a pressure of 8 bar. The IR absorption at 1730 $cm^{-1}$ and 1630 $cm^{-1}$ is then determined. The greater these values, the greater is the effect of the stabilizers. Tables 2a and 2b demonstrate the results at various temperatures.

TABLE 2a

| Oxidation at 120° C. | | |
|---|---|---|
| | IR Absorption | |
| Stabilizer | at 1730 $cm^{-1}$ | at 1630 $cm^{-1}$ |
| 0.55% of A-1 | 0.471 | 1.051 |
| 0.45% of A-1 + 0.10% of H-2 | 0.392 | 0.839 |
| 0.45% of A-1 + 0.10% of H-3 | 0.424 | 0.863 |
| 0.45% of A-1 + 0.10% of H-5 | 0.396 | 0.673 |

TABLE 2b

| Oxidation at 150° C. | | |
|---|---|---|
| | IR Absorption | |
| Stabilizer | at 1730 $cm^{-1}$ | at 1630 $cm^{-1}$ |
| 0.55% of A-1 | 0.557 | 1.851 |
| 0.45% of A-1 + 0.10% of H-4 | 0.353 | 1.500 |
| 0.65% of A-1 | 0.384 | 1.599 |
| 0.45% of A-1 + 0.10% of H-4 + 0.10% of phenol B*) | 0.330 | 1.279 |
| 0.45% of A-1 + 0.10% of A-2 + 0.10% of H-4 | 0.340 | 1.443 |

*)phenol B = compound of the formula

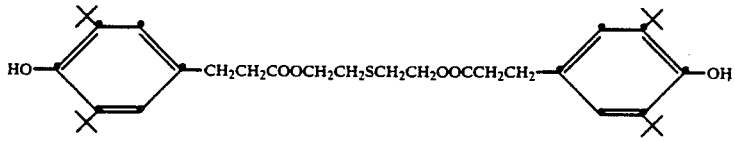

EXAMPLE 3

The oxidation characteristics of the lubricating oils stabilized according to the invention were also tested by the TOST (turbine oxidation stability test) method according to ASTM D-943. For this purpose 60 ml of water are added to 300 ml of a mineral oil (Mobil STOC K 305) and the oil is heated in the presence of iron or copper wire at 95° C. for 1000 hours, while oxygen is passed through. The measured parameters are formation of acids by determining the neutralization value TAN (mg of KOH/g of oil) and the amount of sludge formed.

For the stabilization either the amine A-1 is used on its own or in admixture with the hindered amine H-7 (2,2,6,6-tetramethyl-4-dodecyloxypiperidine), the total concentration of the stabilizers being always 0.25%, based on the oil.

| A-1 | H-7 | TAN (mg KOH/g of oil) | Sludge (mg) |
|---|---|---|---|
| 100% | — | 0.46 | 30 |
| 95% | 5% | 0.38 | 27 |
| 90% | 10% | 0.30 | 24 |
| 75% | 25% | 0.31 | 27 |

EXAMPLE 4

By analogy with Example 1, the induction period of the oxidation is measured at 170° C. For this purpose the following hindered amines are used:

H-8 N,N'-bis(2,2,6,6-tetramethylpiperidin-4-yl)hexamethylenediamine

H-9 N,N'-bis(2,2,6,6-tetramethylpiperidin-4-yl)pentamethylenediamine

H-10 4-(methoxypropylamino)-2,2,6,6-tetramethylpiperidine

TABLE 4

| Aromatic amine | Hindered amine | Induction period (min) |
|---|---|---|
| — | — | 48 |
| 0.55% of A-1 | — | 86 |
| 0.45% of A-1 | 0.10% of H-8 | 95 |
| 0.45% of A-1 | 0.10% of H-9 | 96 |
| 0.45% of A-1 | 0.10% of H-10 | 89 |

EXAMPLE 5

The induction period of the oxidation is determined at 170° C. as described in Example 1. The following aromatic amine is used for this purpose:

A-3 N-(p-octylphenyl)-1-naphthylamine

TABLE 5

| Aromatic amine | Hindered amine | Induction period (min) |
|---|---|---|
| 0.55% of A-3 | — | 52.8 |
| 0.45% of A-3 | 0.10% of H-7 | 66 |

EXAMPLE 6

Oxidation resistance can be also determined by measuring the viscosity increase when the oil is treated with oxygen at elevated temperature.

For this purpose a stream of oxygen (1 liter/h) is passed through the oil at 150° C. for 70 hours. The susceptibility of the oil to oxidation is first boosted by the addition of a catalytic amount of copper naphthenate. The viscosity of the oil is measured before and after the oxidation using an Ubbelode viscometer.

TABLE 6

| Oil | Percentage viscosity increase |
|---|---|
| base oil | 168% |

TABLE 6-continued

| Oil | Percentage viscosity increase |
|---|---|
| base oil containing 0.6% of A-1 and 0.15% of H-8 | 3.4% |

We claim:

1. A lubricant composition which comprises (A) a mineral or synthetic base oil or a mixture of such oils, (B) at least one aromatic amine of the formula I

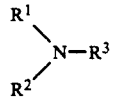

(I)

in which $R^1$ is $C_1$–$C_{18}$alkyl, $C_7$–$C_9$phenylalkyl, $C_5$–$C_{12}$cycloalkyl, phenyl, $C_7$–$C_{18}$alkylphenyl, $C_7$–$C_{18}$alkoxyphenyl or naphthyl, $R^2$ is phenyl, $C_7$–$C_{18}$-alkylphenyl, $C_7$–$C_{18}$alkoxyphenyl or naphthyl, $R^3$ is hydrogen, $C_1$–$C_{12}$alkyl, benzyl, allyl, methallyl, phenyl, or a group $—CH_2SR^4$, $R^4$ is $C_4$–$C_{18}$alkyl, $—CH_2COO(C_4–C_{18}alkyl)$ or $—CH_2CH_2COO(C_4–C_{18}alkyl)$, and (C) at least one sterically hindered amine contain at least one trivalent group of the formula III

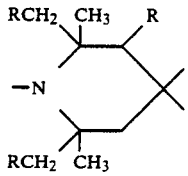

(III)

in which R is hydrogen or methyl.

2. The composition according to claim 1 which comprises as the component (B) at least one compound of the formula I, in which $R^1$ is $C_1$–$C_4$alkyl, $C_7$–$C_9$phenylalkyl, cyclohexyl, phenyl, $C_{10}$–$C_{18}$alkylphenyl or naphthyl, $R^2$ is $C_{10}$–$C_{18}$-alkylphenyl or phenyl, $R^3$ is hydrogen, $C_1$–$C_8$alkyl, benzyl, allyl or a group $—CH_2SR^4$, $R^4$ is $C_8$–$C_{18}$alkyl or $—CH_2COO(C_8–C_{18}alkyl)$.

3. The composition according to claim 1 which comprises as the component (B) at least one compound of the formula I, wherein $R^1$ and $R^2$ independently of one another are phenyl or $C_{10}$–$C_{18}$alkylphenyl and $R^3$ is hydrogen.

4. The composition according to claim 1 which comprises as the component (B) 4,4'-di-tert-octyldiphenylamine, or a mixture of aromatic amines obtained by reacting diphenylamine with diisobutylene.

5. The composition according to claim 1, in which R is hydrogen.

6. The composition according to claim 1 which comprises as the component (C) a compound of the formula IV

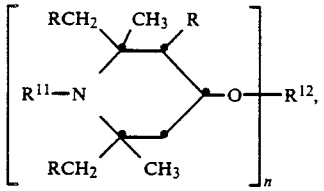

(IV)

in which R is hydrogen, $R^{11}$ is hydrogen or methyl, n is 2 and $R^{12}$ is the diacyl radical of an aliphatic dicarboxylic acid having 4 to 12 carbon atoms.

7. The composition according to claim 1 which comprises as the component (C) a compound of the formula V

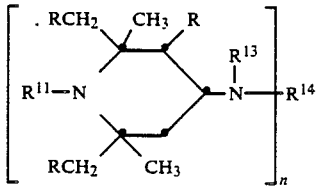

(V)

in which n is 1 or 2, R is hydrogen, $R^{11}$ is hydrogen or methyl, $R^{13}$ is hydrogen, $C_1$–$C_{12}$alkyl or a group of the formula

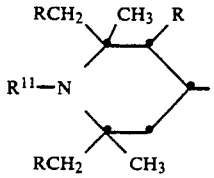

and when n is 1, $R^{14}$ is hydrogen or $C_1$–$C_{12}$alkyl, and when n is 2, $R^{14}$ is $C_2$–$C_8$alkylene.

8. The composition according to claim 1 which comprises as the component (C) a compound of the formula (IX)

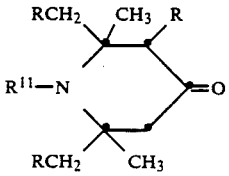

(IX)

wherein R is hydrogen or methyl and $R^{11}$ is hydrogen or methyl.

9. The composition according to claim 1 which comprises 0.1 to 2% by weight of the total of (B) and (C), based on (A).

10. The composition according to claim 1 wherein the ratio of (B) to (C) is 3–5 parts by weight of (B) per part by weight of (C).

11. The composition according to claim 1 which additionally contains a phenolic antioxidant (D).

12. The composition according to claim 1 which additionally contains an aliphatic or aromatic phosphite or phosphonite (E).

* * * * *